US006460469B1

(12) United States Patent
Dickinson et al.

(10) Patent No.: US 6,460,469 B1
(45) Date of Patent: Oct. 8, 2002

(54) SHELF WITH SHELF ANCHOR

(75) Inventors: Thomas Dickinson, St. Louis; Scott Holmberg, Ballwin, both of MO (US)

(73) Assignee: Contico International LLC, St. Louis, MO (US)

( * ) Notice: Subject to any disclaimer, the term of this patent is extended or adjusted under 35 U.S.C. 154(b) by 0 days.

(21) Appl. No.: 09/624,783

(22) Filed: Jul. 25, 2000

(51) Int. Cl.[7] ..... A47B 5/00
(52) U.S. Cl. ..... 108/152; 248/250; 108/108
(58) Field of Search ..... 108/152, 108, 108/107; 248/544, 250, 235, 220.21, 221.11, 222.11, 223.41, 225.11, 229.16

(56) References Cited

U.S. PATENT DOCUMENTS

| | | | | |
|---|---|---|---|---|
| 883,323 A | | 3/1908 | Macduff | |
| 1,279,416 A | | 9/1918 | Osborne | |
| 1,502,288 A | | 7/1924 | Boye | |
| 2,219,975 A | | 10/1940 | Bentz | |
| 3,631,821 A | * | 1/1972 | Zachariou | 108/152 |
| 3,675,882 A | | 7/1972 | Dibble | |
| 3,704,675 A | * | 12/1972 | Bellasalma | 108/152 |
| 4,183,488 A | | 1/1980 | Shepard | |
| 4,646,998 A | | 3/1987 | Pate | |
| 4,738,426 A | | 4/1988 | Bessinger | |
| 4,783,035 A | | 11/1988 | Remmers | |
| 4,799,643 A | | 1/1989 | Shepard | |
| 5,156,096 A | * | 10/1992 | Lamprey | 108/152 |
| 5,527,084 A | * | 6/1996 | Scherf | 108/152 X |
| 5,799,803 A | * | 9/1998 | Muller | 108/152 X |

FOREIGN PATENT DOCUMENTS

| | | | |
|---|---|---|---|
| AU | 202504 | * | 7/1956 |

* cited by examiner

*Primary Examiner*—Jose V. Chen
(74) *Attorney, Agent, or Firm*—Pennie & Edmonds LLP

(57) ABSTRACT

A shelving unit comprises a shelf and a shelf anchor for securing the shelf to an adjacent wall. The shelf has a generally vertical peripheral rim. The shelf anchor includes a base and a shelf retainer. The base has opposite front and rear sides. The rear side of the base has a wall-engaging portion adapted for flush engagement with the wall. The shelf retainer has a bridge portion and a shelf-retaining portion. The bridge portion extends outwardly from the front side of the base. The shelf-retaining portion extends generally vertically from a distal end of the bridge portion. The shelf-retaining portion is spaced from the front side of the base to define a rim-receiving recess between the front side of the base and the shelf-retaining portion. The shelf retainer is positioned relative to the shelf so that at least a portion of the peripheral rim is received within the rim-receiving recess. The rim is received within the recess in a manner to prevent the shelf from moving outwardly from the wall when the shelf anchor is mounted to the wall.

21 Claims, 3 Drawing Sheets

SHELF WITH SHELF ANCHOR

BACKGROUND OF THE INVENTION

The present invention pertains to shelving and, more particularly, to shelving units for general household and utility use. A variety of shelf structures and shelving assemblies are known in the art. Many shelving assemblies are provided as "knock down" kits for assembly by the user at a location where the shelving assembly is to be used. This minimizes shipping costs by avoiding the need to transport bulky shelving assemblies. Such knock down shelving assemblies typically include a plurality of generally planar shelves separated by poles connected to the corners of the shelves. The interconnecting components are usually inexpensive and are typically made of a light weight polymeric material, such as molded polypropylene, to further reduce manufacturing and shipping costs.

Most knock down shelving assemblies are intended for use as stand alone units and, in general, they are sufficiently strong and stable for their intended purposes, despite their light weight construction. However, the light weight construction increases the propensity for tipping when improperly loaded. For example, the unbalanced load of a child climbing on one side of the shelving unit may cause the entire unit, and all things stored thereon, to tip over onto the child.

To reduce the likelihood of such dangers, various support brackets have been devised for securing shelves to adjacent walls. In general, such prior art brackets are secured to a wall in a selected location where the shelving unit is to be used. The shelving unit is moved into place and then connected to the pre-mounted bracket. While this is generally effective in preventing tipping of the shelving unit, mounting such brackets in a proper location on the wall before the shelving unit is moved into place can be difficult. Moreover, such brackets are typically designed for connection to particular portions of the shelving unit and are fixed relative thereto once connected. Therefore, although the user may have a particular location in mind for the shelving unit, the precise location may be dictated, at least in part, by the location of wall studs to which to brackets may be mounted.

Thus, there is a need for a shelving unit having mounting brackets or "anchors" that are connectable to the unit prior to being secured to a wall, and which are adjustable relative the shelf once connected to permit precise positioning of the anchor relative to the wall.

SUMMARY OF THE INVENTION

It is a general object of the present invention to provide a shelving unit including a shelf anchor configured for securing the shelving unit to an adjacent wall to prevent tipping. A more specific object of the invention is to provide a shelving unit having a mounting anchor that is connectable to the shelving unit prior to being secured to a wall, and which is adjustable relative the shelving unit after being connected thereto.

In general, a shelving unit of the present invention comprises a shelf and a shelf anchor for securing the shelf to an adjacent wall. The shelf has a generally vertical peripheral rim. The shelf anchor includes a base and a shelf retainer. The base has opposite front and rear sides. The rear side of the base has a wall-engaging portion adapted for flush engagement with the wall. The shelf retainer has a bridge portion and a shelf-retaining portion. The bridge portion extends outwardly from the front side of the base. The shelf-retaining portion extends generally vertically from a distal end of the bridge portion. The shelf-retaining portion is spaced from the front side of the base to define a rim-receiving recess between the front side of the base and the shelf-retaining portion. The shelf retainer is positioned relative to the shelf so that at least a portion of the peripheral rim of the shelf is received within the rim-receiving recess. The rim is received within the recess in a manner to prevent the shelf from moving outwardly from the wall when the shelf anchor is mounted to the wall.

In another aspect of the invention, a shelf anchor comprises a base and a shelf retainer. The base has opposite front and rear sides. The rear side of the base has a wall-engaging portion adapted for flush engagement with a wall. The shelf retainer extends from the front side of the base portion. The shelf retainer has a generally rearwardly facing surface adapted for engagement with a generally forwardly facing surface of the shelf. The rearwardly facing surface of the shelf retainer and the generally forwardly facing surface of the shelf are adapted to engage one another in a manner to prevent the shelf from moving outwardly from the wall when the shelf anchor is mounted to the wall.

The present invention also includes a method for securing a shelving unit to a wall. The method comprises the steps of: providing a shelf anchor having a rim-receiving recess adapted to receive at least a portion of a peripheral rim of one shelf of the shelving unit; positioning the shelf anchor on the peripheral rim of the shelf so that at least a portion of the peripheral rim is received within the rim-receiving recess; and securing the shelf anchor to the wall.

While the principal advantages and features of the present invention have been described above, a more complete and thorough understanding and appreciation for the invention may be attained by referring to the drawings and description of the preferred embodiments, which follow.

Figure 1:
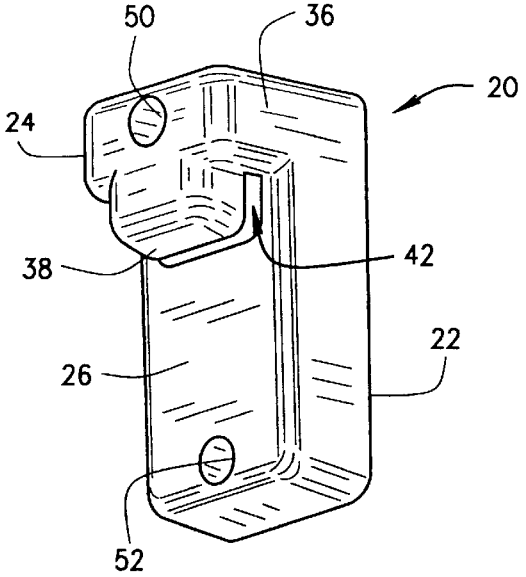
FIG. 1 is a front perspective view of a shelf anchor of the present invention.

Reference characters in these Figures correspond to reference characters in the following detailed description of the preferred embodiments.

DETAILED DESCRIPTION OF THE PREFERRED EMBODIMENTS

Figure 2:
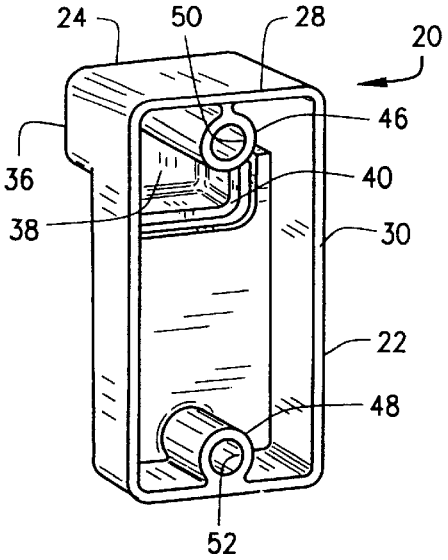
FIG. 2 is a rear perspective view of the shelf anchor of FIG. 1.
Figure 3:
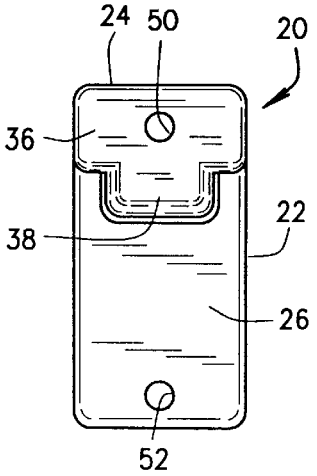
FIG. 3 is a front elevational view of the shelf anchor of FIG. 1.

A shelf anchor of the present invention is shown in detail in FIGS. 1 through 7, and is represented generally by the reference numeral 20. In general, the shelf anchor 20 comprises a base 22 and a shelf retainer 24. The base 22 has a front side 26 and an opposite rear side 28. The rear side 28 of the base 22 has a wall-engaging portion 30 adapted for flush engagement with a wall (not shown). As best shown in FIG. 2, the shelf anchor is preferably molded as a monolithic hollow piece, to reduce material costs and overall weight of the shelving unit. However, the shelf anchor could comprise multiple pieces or could be made as a solid structure without departing from the scope of the present invention. Preferably, the shelf anchor is molded of a suitable polymeric material, such as polypropylene, but other materials could be used and other manufacturing methods could be employed without departing from the scope of the present invention.

Figure 4:
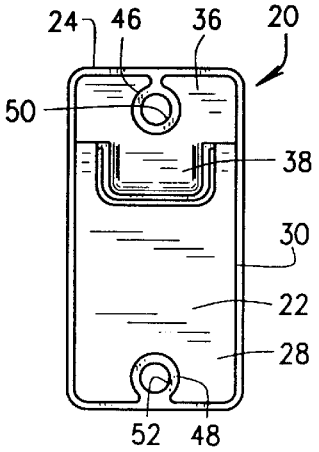
FIG. 4 is rear elevational view of the shelf anchor of FIG. 1.

In the hollow configuration of the preferred embodiment of the shelf anchor 20 shown in FIGS. 2 and 4, the wall-engaging portion 30 of the anchor 20 is in the form of a relatively narrow, generally rectangular rim. In most cases, the shelf anchor 20 be will be mounted to a flat wall, so preferably, the entire wall-engaging portion 30 lies in a single plane.

Figure 5:
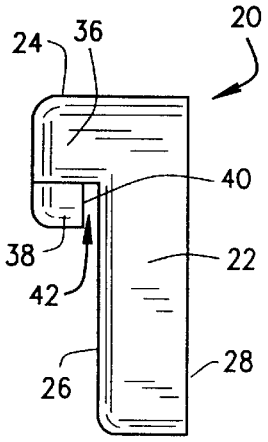
FIG. 5 is a right side elevational view of the shelf anchor of FIG. 1, the left side elevational view being a mirror image thereof.
Figure 6:
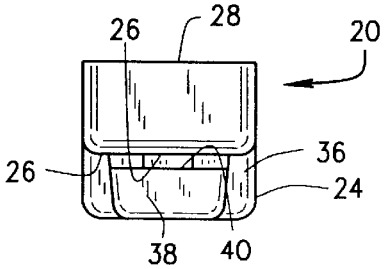
FIG. 6 is a bottom plan view of the shelf anchor of FIG. 1.
Figure 7:
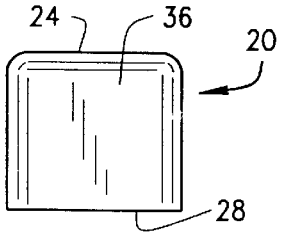
FIG. 7 is a top plan view of the shelf anchor of FIG. 1.

The shelf retainer 24 has a bridge portion 36 and a shelf-retaining portion 38. As best shown in FIGS. 1 and 5, the bridge portion 36 extends outwardly and generally horizontally from the front side 26 of the base 22. The shelf-retaining portion 38 extends generally vertically from a distal end of the bridge portion 36 so that a generally rearwardly facing surface 40 of the shelf-retaining portion 38 is spaced from the front side 26 of the base 22. As shown in the Figures, the shelf-retaining portion 38 preferably extends generally downwardly from the distal end of the bridge portion 36 to define a recess 42 between the rearwardly facing surface 40 of the shelf-retaining portion 38 and the front side 26 of the base 22. The importance of the recess 40 is explained below.

Figure 9:
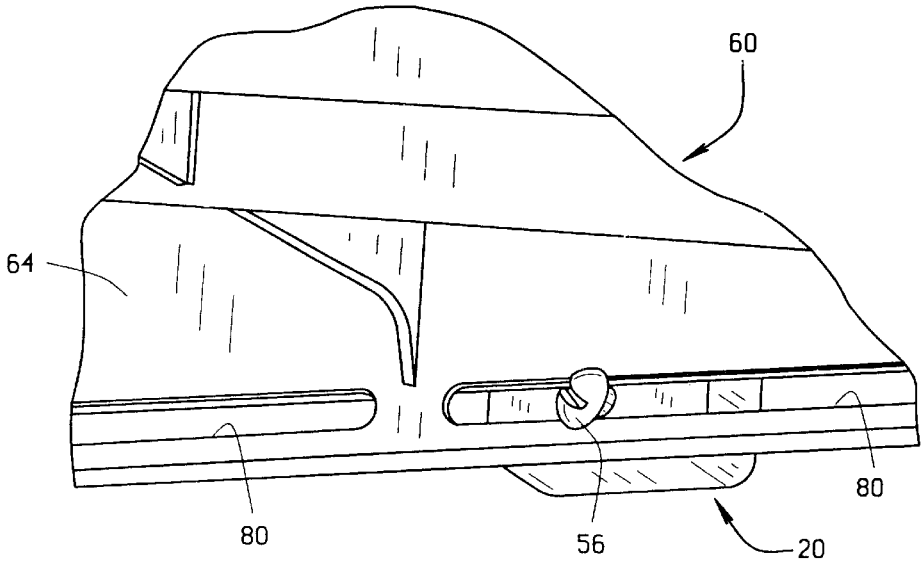
FIG. 9 is fragmented front perspective view of the shelf anchor secured to a lower part of the shelf with a mechanical fastener.
Figure 10:
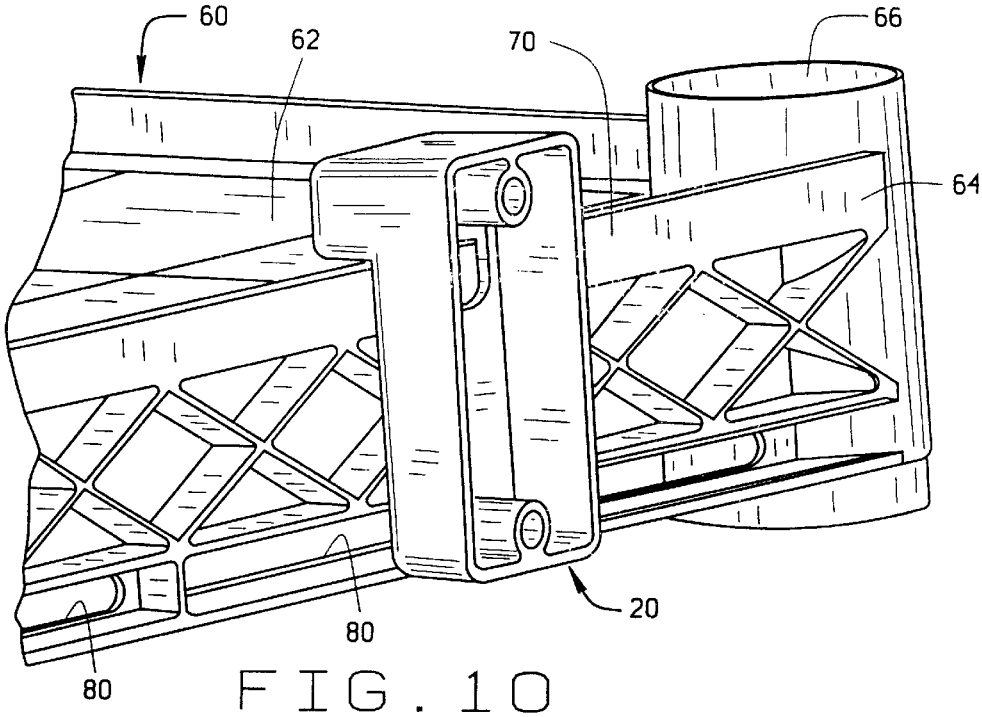
FIG. 10 is fragmented rear perspective view of the shelf anchor positioned on the peripheral rim of the shelf.

As shown in FIGS. 2, 4 and 10, the hollow shelf anchor of the preferred embodiment preferably includes a pair of bosses 46 and 48, which define holes 50 and 52 adapted to receive mechanical fasteners 56 (see FIGS. 8, 9 and 11) for securing the anchor 20 to a wall (not shown).

A shelf used with the present invention is shown in FIGS. 8 through 11, and is represented generally by the reference numeral 60. In general, the shelf 60 comprises a generally horizontal load supporting surface 62 and a vertical peripheral wall 64. Post-receiving cylinders 66 are provided at corners of the shelf 60 for receiving shelf-supporting posts (not shown). Preferably, an upper portion of the vertical peripheral wall 64 defines a generally vertical peripheral rim 70 of the shelf 60, which extends upwardly from the load supporting surface 62. Preferably, the shelf 60 is also molded of a polymeric material, such as polypropylene, but other materials could be used and other manufacturing methods could be employed without departing from the scope of the present invention.

Figure 8:
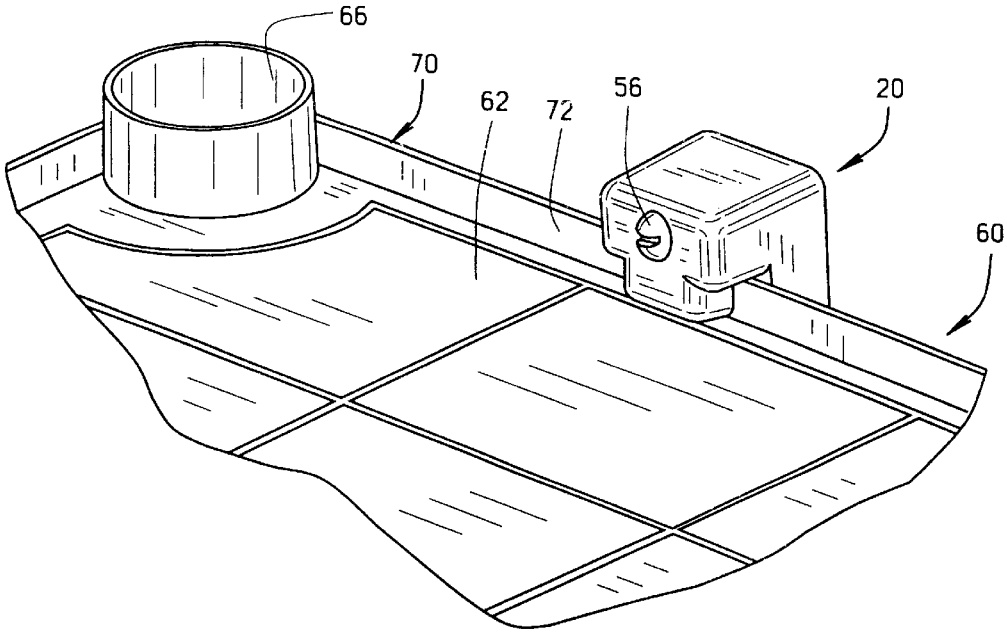
FIG. 8 is a fragmented front perspective view of the shelf anchor of the present invention positioned on the peripheral rim of a shelf.
Figure 11:
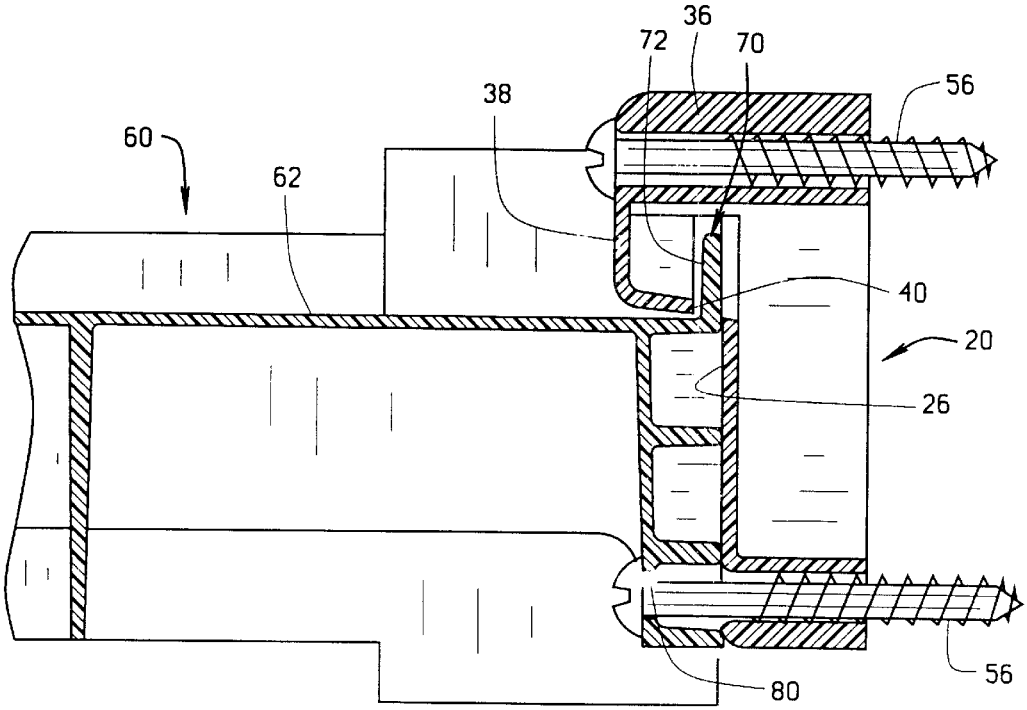
FIG. 11 is cross-sectional side view of the shelf anchor positioned on the peripheral rim of the shelf.

As shown in FIGS. 8, 10 and 11, the rim-receiving recess 42 is sized to receive at least an upper portion of the vertical peripheral rim 70 of the shelf 60 therein. The vertical peripheral rim 70 of the shelf 60 includes a generally forwardly facing surface 72, which is adapted for engagement with the rearwardly facing surface 40 of the shelf-retaining portion 38 of the shelf anchor 20, when the shelf anchor 20 is connected to the shelf 60 as shown in FIGS. 8, 10 and 11. Thus, when the shelf anchor 20 is secured to a wall (not shown) and the peripheral rim 70 of the shelf 60 is received within the recess 42, the forwardly facing surface 72 of the rim 70 engages against the rearwardly facing surface 40 of the shelf-retaining portion 38 of the shelf anchor 20 to prevent the shelf 60 from moving outwardly away from the wall.

To this point, the preferred embodiment of the shelf anchor 20 has been described as having a shelf retaining portion 38 that extends generally downwardly to define a downwardly facing recess 42 adapted to receive a portion of the peripheral rim 70 upwardly therein. However, alternatively, the anchor could be constructed with a shelf retaining portion that extends generally upwardly to define an upwardly facing recess for receiving a peripheral wall or rim downwardly therein.

Preferably, the recess 42 comprises a channel that extends generally transversely of the front side 26 of the base 22 and generally parallel to the wall when the shelf anchor 20 is mounted to the wall to permit transverse sliding movement of the shelf anchor 20 relative to the peripheral rim 70 of the shelf 60 when the rim 70 is received within the recess 42. Thus, the shelf anchor 20 is slidable transversely along the length of rim 70, with the rearwardly facing surface 40 of the shelf retaining portion 38 in sliding engagement with the forwardly facing surface 72 of the rim 70. This permits precise lateral positioning of the shelf anchor 20 relative to the shelf 60 and relative to the wall after the anchor 20 has been connected the shelf 60. This is beneficial because, once the shelving unit has been positioned against a wall, the anchors 20 can be moved laterally along the rim 70 of the shelf 60, e.g., for alignment with wall studs, without the need to move the entire shelving unit.

As shown in FIGS. 9 and 11, the vertical peripheral wall 64 of the shelf 60 preferably includes a transverse slot 80 or other aperture adapted for receiving one of the mechanical fasteners 56 therethrough. By fastening the shelf anchor 20 to the shelf 60 with a mechanical fastener 56 passing through the slot 80, the position of the shelf anchor 20 can be fixed relative to the rim 70, after the shelf anchor has been moved to a desired location on the rim 70.

The present invention also includes a novel method of securing a shelving unit of the type described above to a wall, where the shelving unit includes at least one shelf having a peripheral rim. In general, the method comprises the steps of: providing a shelf anchor having a rim-receiving recess adapted to receive at least a portion of the peripheral rim of the shelf; positioning the shelf anchor on the peripheral rim of the shelf so that at least a portion of the peripheral rim is received within the rim-receiving recess; and securing the shelf anchor to the wall. Preferably, the step of securing the shelf anchor to the wall is performed after the step of positioning the shelf anchor on the peripheral rim of the shelf. Also, preferably, the step of securing the shelf anchor to the wall includes sliding the shelf anchor transversely along the peripheral rim of the shelf to a selected location. Again, this is beneficial because, once the shelving unit has been positioned against a wall, the anchors 20 can be moved laterally along the rim 70 of the shelf 60, e.g., for alignment with wall studs, without the need to move the entire shelving unit.

While the present invention has been described by reference to specific embodiments and specific uses, it should be understood that other configurations and arrangements could be constructed, and different uses could be made, without departing from the scope of the invention as set forth in the following claims.

What is claimed is:

1. A shelving unit comprising:

a shelf having a generally horizontal load supporting surface defined by an outer border and a generally vertical peripheral rim extending around the outer border of the horizontal load supporting surface, the vertical rim having an upper portion extending vertically above the horizontal load supporting surface; and a shelf anchor for securing the shelf to an adjacent wall, the shelf anchor including:

a base with opposite front and rear sides, the rear side of the base having a wall-engaging portion adapted for flush engagement with the wall; and a shelf retainer having a bridge portion extending outwardly from the front side of the base and a shelf-retaining portion extending generally vertically downwardly from a distal end of the bridge portion, the shelf-retaining portion being spaced from the front side of the base to define a rim-receiving recess between the front side of the base and the shelf-retaining portion, the rim-receiving recess opening generally downwardly, the shelf retainer being positioned relative to the shelf so that the upper portion of the peripheral rim is received upwardly within the rim-receiving recess in a manner to prevent the shelf from moving outwardly from the wall when the shelf anchor is mounted to the wall.

2. The shelving unit of claim 1 wherein the shelf-retaining portion includes a generally rearwardly facing surface that engages a generally forwardly facing surface of the peripheral rim of the shelf in a manner to prevent the shelf from moving outwardly from the wall when the shelf anchor is mounted to the wall.

3. The shelving unit of claim 2 wherein the rearwardly facing surface of the shelf retainer is in sliding engagement with the forwardly facing surface of the shelf.

4. The shelving unit of claim 1 wherein the rim-receiving recess comprises a channel that extends generally transversely of the front side of the base.

5. The shelving unit of claim 4 wherein the channel extends generally parallel to the wall when the shelf anchor is mounted to the wall to permit transverse sliding movement of the shelf anchor relative to the peripheral rim of the shelf when the rim is received within the channel.

6. The shelving unit of claim 1 wherein the base has at least one bore extending therethrough from the front side to the rear side, the bore being adapted for receiving a mechanical fastener in a manner for mounting the base to the wall.

7. The shelving unit of claim 1 wherein the base and the shelf retainer are molded of a polymeric material.

8. The shelving unit of claim 1 wherein the base and the shelf retainer are of a monolithic construction.

9. The shelving unit of claim 1 wherein the shelf vertical peripheral rim has a lower portion extending below the horizontal load supporting surface around the outer border of the horizontal load supporting surface, the lower portion has a opening formed therein that aligns with a bore in the shelf anchor base portion, the opening and bore being adapted to receive a mechanical faster in a manner for securing the shelving unit to the adjacent wall.

10. The shelving unit of claim 9 wherein the opening is a transverse slot extending laterally along a portion of the lower portion of vertical peripheral rim.

11. A shelf anchor for securing a shelf to a wall wherein the shelf has a horizontal load supporting surface defined by an outer border and a vertical peripheral rim extending around the outer border of the horizontal load supporting surface, a portion of the vertical peripheral rim extending above the horizontal load supporting surface, the shelf anchor comprising:

a base having opposite front and rear sides, the rear side of the base having a wall-engaging portion adapted for flush engagement with the wall when the shelf anchor is mounted to the wall; and a shelf retainer extending from the front side of the base portion, the shelf retainer having a depending shelf retainer portion spaced from the front side of the base portion by a bridge portion to define a rim-receiving recess that opens downwardly, the shelf retainer portion having a generally rearwardly facing surface adapted for engagement with a generally forwardly facing surface of the upper portion of the vertical peripheral rim of the shelf in a manner to prevent the shelf from moving outwardly from the wall when the shelf anchor is mounted to the wall and the upper portion of the vertical peripheral rim is upwardly received in the rim-receiving area.

12. The shelf anchor of claim 11 wherein the rearwardly facing surface of the shelf retainer portion is adapted for sliding engagement with the forwardly facing surface of the upper portion of vertical peripheral rim of the shelf.

13. The shelf anchor of claim 11 wherein the base and the shelf retainer are of a monolithic construction.

14. The shelf anchor of claim 11 wherein the base has at least one bore extending therethrough from the front side to the rear side, the bore being adapted for receiving a mechanical fastener in a manner for mounting the base to the wall.

15. The shelf anchor of claim 11 wherein the shelf anchor base portion has a lower member spaced from the bridge portion adapted to be mounted flush with the wall and a bore extending through the lower member, the bore being adapted to align with an opening in a lower portion of the vertical peripheral rim extending below the horizontal load supporting surface of the shelf, the bore and the opening being adapted to receive a mechanical fastener in a manner for mounting the shelf anchor to the wall.

16. A method of securing a shelving unit having at least one shelf with a generally vertical peripheral rim to a wall, the method comprising the steps of:

providing a shelf anchor having a rim-receiving recess adapted to receive at least a portion of the peripheral rim of the shelf; and positioning the shelf anchor on the peripheral rim of the shelf so that at least a portion of the peripheral rim is received within the rim-receiving recess;

securing the shelf anchor to the wall after the step of positioning the shelf anchor on the peripheral rim of the shelf;

wherein the step of positioning the shelf anchor comprises positioning the rim-receiving recess of the shelf anchor to open downwardly and moving the shelf anchor downwardly in a manner such that the portion of the shelf vertical peripheral rim is upwardly received in the rim-receiving recess.

17. The method of claim 16 wherein the step of securing the shelf anchor to the wall includes sliding the shelf anchor transversely along the peripheral rim of the shelf to a selected location.

18. A method of securing a shelving unit having at least one shelf with a generally vertical peripheral rim to a wall, the method comprising the steps of:

providing a shelf anchor having a rim-receiving recess adapted to receive at least a portion of the peripheral rim of the shelf; and positioning the shelf anchor on the peripheral rim of the shelf so that at least a portion of the peripheral rim is received within the rim-receiving recess;

securing the shelf anchor to the wall after the step of positioning the shelf anchor on the peripheral rim of the shelf;

wherein the step of positioning the shelf anchor on the portion of the vertical peripheral rim of the shelf includes positioning the rim-receiving recess to capture a distal portion of the vertical peripheral rim that extends above a horizontal load supporting surface of the shelf.

19. The method of claim 18 wherein the step of securing the shelf anchor to the wall includes sliding the shelf anchor transversely along the peripheral rim of the shelf to a selected location.

20. The method of claim 18 further comprising assembling the shelving unit to be free-standing and arranging the shelf to be self-supporting therein, the steps of assembling and arranging being performed before positioning the shelf anchor on the vertical peripheral rim of the shelf.

21. The method of claim 20 wherein the steps of assembling and arranging include positioning the shelving unit at a desired location relative to the wall.

* * * * *